US007062208B2

(12) United States Patent
Takayanagi

(10) Patent No.: US 7,062,208 B2
(45) **Date of Patent: *Jun. 13, 2006**

(54) IMAGE FORMING APPARATUS FEATURING FIRST AND SECOND TONER IMAGES WITH DIFFERENT CHARGING AMOUNTS

(75) Inventor: Hiroki Takayanagi, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/990,491

(22) Filed: Nov. 18, 2004

(65) Prior Publication Data

US 2005/0095042 A1 May 5, 2005

Related U.S. Application Data

(62) Division of application No. 10/361,613, filed on Feb. 11, 2003, now Pat. No. 6,842,600.

(30) Foreign Application Priority Data

Feb. 15, 2002 (JP) ..... 2002-038612

(51) Int. Cl.
*G03G 15/16* (2006.01)

(52) U.S. Cl. ..... 399/296

(58) Field of Classification Search ..... 399/49, 399/50, 53, 66, 223, 227, 231, 296, 298, 399/299, 302, 308, 309
See application file for complete search history.

(56) References Cited

U.S. PATENT DOCUMENTS

| | | | | |
|---|---|---|---|---|
| 4,937,630 | A | 6/1990 | Yoshikawa et al. | |
| 5,189,478 | A | 2/1993 | Hara et al. | |
| 5,640,654 | A | 6/1997 | Yoshizawa | 399/227 |
| 5,797,069 | A | 8/1998 | Kimura et al. | 399/113 |
| 5,918,092 | A | 6/1999 | Hama | 399/227 |
| 5,987,290 | A | 11/1999 | Bisaiji | 399/296 |
| 6,349,190 | B1 | 2/2002 | Liu et al. | 399/223 |
| 6,484,004 | B1 | 11/2002 | Schein et al. | 399/223 |
| 6,842,600 | B1 * | 1/2005 | Takayanagi | 399/296 |

FOREIGN PATENT DOCUMENTS

JP 11-231597 8/1999

* cited by examiner

*Primary Examiner*—Sandra L. Brase
(74) *Attorney, Agent, or Firm*—Fitzpatrick, Cella, Harper & Scinto

(57) ABSTRACT

An image forming apparatus has a latent image forming portion for forming an electrostatic latent image on an image bearing member; a plurality of developing portions for developing the electrostatic latent image on the image bearing member with a developer; a primary transferring portion for transferring by sequentially superposing each developer image developed by the plurality of developing portions on an intermediate transferring member; a secondary transferring portion for collectively transferring onto a transferring material the developer images transferred by being superposed on the intermediate transferring member; and a charging portion for charging the developer images on the image bearing member; wherein the charging portion decides a charging condition in accordance with the order of transferring the developer images onto the intermediate transferring member.

3 Claims, 7 Drawing Sheets

⟨ CHARGE AMOUNT OF TONER ON INTERMEDIATE TRANSFERRING BELT VERSUS ⟩

IMAGE FORMING APPARATUS FEATURING FIRST AND SECOND TONER IMAGES WITH DIFFERENT CHARGING AMOUNTS

CROSS-REFERENCE TO RELATED APPLICATION

This application is a divisional application of application Ser. No. 10/361,613, filed Feb. 11, 2003.

BACKGROUND OF THE INVENTION

1. Field of the Invention

The present invention relates to an image forming apparatus using an electrophotographic method. In particular, the present invention relates to an image forming apparatus based on a system in which a plurality of developing devices is disposed around a photosensitive drum, and a toner image formed on the photosensitive drum is collectively transferred onto a transferring material after each color is superposed on an intermediate transferring member.

2. Related Background Art

Heretofore, such color image forming apparatuses based on an electrophotographic system have been known that comprise a second image bearing member such as an intermediate transferring member in addition to a first image bearing member such as a photosensitive drum. In these apparatuses, a so-called primary transfer is performed for transferring a toner image formed on the first image bearing member onto the second image bearing member, and this primary transfer step is repeated more than once so as to superpose the toner images of a plurality of colors on the second image bearing member, before collectively secondary-transferring these toner images of a plurality of colors onto a conveyed transferring material such as a sheet, and then the toner images are fixed onto the transferring material by a fixing device through melting and pressure fixing.

FIG. 4 shows an example of the image forming apparatus constituted as above which uses an intermediate transferring belt (intermediate transferring member) as the second image bearing member.

A photosensitive drum 3 that rotates in a direction of an arrow A is evenly charged by a charger 5, and an electrostatic latent image is formed by a laser light 6.

Three developing devices 1-1, 1-2 and 1-3 which store toners of colors including three colors of Y, M and C respectively, and a developing device 1-4 which stores a toner of Bk are disposed around the photosensitive drum 3.

One of these developing devices 1-1, 1-2 and 1-3 is selected to come close to the photosensitive drum 3 by changing means 4, while the developing device 1-4 is always close thereto, and one of these two developing devices close thereto is used for developing the electrostatic latent image on the photosensitive drum 3, thereby forming a toner image on the photosensitive drum 3.

As to the arrangement constitution of the developing devices described above, the diameter of the photosensitive drum becomes large if all the four developing devices of Y, M, C and Bk are constituted to be close to the circumference of the photosensitive drum, which leads to a size increase of the apparatus and increased costs, so that the developing device containing the frequently used Bk toner is always close to the circumference of the photosensitive drum, while, as to the three developing devices of Y, M and C, one of these three developing devices is automatically selected to come close to the photosensitive drum, thereby achieving a smaller diameter of the photosensitive drum in accordance with this constitution.

Furthermore, a one-component developing method using a magnetic one-component toner is applied to the Bk (black) which is mostly used for text information and frequently used with demands for lower costs, and a two-component developing method comprising a non-magnetic toner and a magnetic carrier is applied to the Y (yellow), M (magenta) and C (cyan) in response to demands for improved image quality, thus combining the two developing methods.

Next, a bias is applied to a primary transferring roller 8 so that a charge having a polarity reverse to that of the toner is given onto a rear surface of an intermediate transferring belt 7, and the toner image developed on the photosensitive drum 3 is primary-transferred onto the intermediate transferring belt 7 via a primary transferring portion (primary transferring nip) 9. A primary transferring residual toner remaining on the surface of the photosensitive drum 3 that has finished the primary transfer is removed and collected by a cleaning member 13, and further residual charge is removed by an exposure 14, and then an image forming process of a next color is started.

This primary transferring step is repeated for the toner images of the four colors, thus forming a full color toner image with the four colors superposed on the intermediate transferring belt 7. Then, a charge having a polarity reverse to that of the toner is given from a secondary transferring outer roller 10*b* to which a bias is applied onto a rear surface of a transferring material 12 which is held and conveyed by a secondary transferring portion 11 formed among a secondary transferring inner roller 10*a*, the intermediate transferring belt 7 and the secondary transferring outer roller 10*b*, so as to secondary-transfer the above full color toner image collectively onto the transferring material 12. The full color toner image is fixed by an unillustrated fixing device to obtain an image on the transferring material 12. A secondary transferring residual toner remaining on the intermediate transferring belt 7 that has finished the above-described secondary transfer is removed by an unillustrated cleaning member.

Rollers having a resistance of equal to or less than $10^{10}$ Ω·cm are generally used as the above primary transferring roller and secondary transferring roller.

For the above intermediate transferring belt 7, a resin belt with no end having a thickness of about 50 to 300 μm in which resistance is adjusted to have a volume resistivity of about $10^{11}$ to $10^{16}$ Ω·cm can be used, as an example. For instance, a resin film such as PVdF (polyvinylidene fluoride), nylon, PET (polyethylene terephthalate) or polycarbonate can be used for the material of the resin belt. Regarding the resistance adjustment, it is possible to adjust the volume resistivity to about $10^{8}$ to $10^{12}$ Ω·cm by using carbon, ZnO, $SnO_2$, $TiO_2$ or other conductive filling materials for the above resin belt. By keeping the resistance to a low to intermediate level in this way, poor image quality due to the accumulation of charge in the intermediate transferring belt 7 can be prevented, and a charge removing system can be dispensed with.

Furthermore, as another example, a rubber material (chloroprene rubber, EPDM, NBR, urethane rubber, etc.) having a hardness lower than that of the resin and a thickness of about 0.5 to 2 mm can be used for the material of the intermediate transferring belt 7 after adjusting it to have a volume resistivity of about $10^{11}$ to $10^{16}$ Ω·cm.

The image forming apparatus above has a one-image mode for forming a toner image of one sheet of transferring material (α) on the intermediate transferring belt 7 and a two-image mode for forming toner images of two sheets (α) and (β), and herein, a case of the two-image mode will be described as an example of changing the order of forming the toner images on the photosensitive drum.

First, toner images (αY) and (βY) of a single color Y are developed in this order on the photosensitive member 3 by the developing device 1-1 selectively close to the photosensitive member 3, and then primary-transferred onto the intermediate transferring belt 7 as shown in FIG. 5A, and while the developing device to be selectively close to the photosensitive member 3 is being changed from the developing device 1-1 to the developing device 1-2, only a toner image (αk) of a single color Bk is developed on the photosensitive member 3 by the developing device 1-4 which is always close to the photosensitive member 3, and then the toner image (αk) is superposed on the toner image (αY) of the single color Y on the intermediate transferring belt 7 for the primary transfer, thereby forming a toner image (αYk) on the intermediate transferring belt 7 as shown in FIG. 5B.

Toner images (βM) and (αM) of a single color M are developed in this order on the photosensitive member 3 by the developing device 1-2 which has been changed and come close to the photosensitive drum 3, and then are sequentially superposed on the toner image (βY) and the toner image (αYk) on the intermediate transferring belt 7 for the primary transfer, so as to form toner images (βYM) and (αYkM) on the intermediate transferring member as shown in FIGS. 5C and 5D, and then, while the developing device to be selectively close to the photosensitive member 3 is being changed from the developing device 1-2 to the developing device 1-3, only a toner image (βk) of the single color Bk is developed on the photosensitive member 3 by the developing device 1-4 which is always close to the photosensitive member 3, and then the toner image (βk) is superposed on the toner image (βYM) on the intermediate transferring belt 7 for the primary transfer so as to form a toner image (βYMk) on the intermediate transferring member as shown in FIG. 5E, and toner images (αC) and (βC) of a single color C are developed in this order on the photosensitive member 3 by the developing device 1-3 which has been changed and come close to the photosensitive drum, and then are sequentially superposed on the toner images (αYkM) and (βYMk) on the intermediate transferring belt 7 for the primary transfer, so as to form toner images (αYkMC) and (βYMkC) on the intermediate transferring member as shown in FIGS. 5F and 5G, and the toner images (αYkMC) and (βYMkC) on the intermediate transferring belt 7 formed by the above repeated primary transferring step are secondary-transferred collectively onto the transferring material 12. The above constitution effectively uses the time when the developing devices of Y, M and C are changed to produce the image of Bk, thereby reducing the time needed for image formation.

Incidentally, it is generally known that a charge amount (triboelectricity) of the Bk toner is smaller than that of the Y, M and C toners. This is attributed to magnetic substances and carbon contained in the Bk toner. It is also known that an optimum transferring bias increases in proportion to the charge amount of the toner. Further, it is also known that the triboelectricity is less in a magnetic Bk toner than in a non-magnetic Bk toner even in the case of the Bks of the same color.

FIG. 6 and FIG. 7 are graphs schematically representing optimum secondary transferring biases in terms of the kind and state of toners. FIG. 6 shows a case where the toners on the photosensitive member are not charged, while FIG. 7 shows a case where the toners on the photosensitive member are charged.

In such states, when the non-magnetic YMC toner and the magnetic Bk toner on the intermediate transferring belt 7 are to be transferred collectively by the secondary transferring nip portion 11, if the optimum secondary transferring bias of the YMC toner is applied to the secondary transferring bias, a poor secondary transfer is caused because the bias is too high for the Bk toner, as shown in FIG. 6, on the other hand, if the optimum secondary transferring bias of the Bk toner is applied to the secondary transferring bias, a poor secondary transfer is caused because the bias is too low for the YMC toner.

Therefore, heretofore, the charge amount of the magnetic Bk toner image on the photosensitive member 3 is increased by a post charger 2 illustrated in FIG. 4 so that the optimum secondary transfer can be applied to both the magnetic toner and the non-magnetic toner as shown in FIG. 7.

In addition, Japanese Patent Application Laid-Open No. 11-231597 discloses a configuration in which a pair of images on a front surface and a rear surface is formed in two image forming portions, and when both the surfaces are collectively transferred simultaneously, the charge amounts of the pair of images on the front and rear surfaces are adjusted to almost correspond by the charger provided in the drum.

However, the above conventional example has the following problems.

While the toner transferred onto the intermediate transferring belt 7 from the photosensitive drum 3 continues to be retained on the intermediate transferring belt 7 even during the first transferring step repeated after that, the charges are given and received between the toner, and the photosensitive drum 3 or the intermediate transferring belt 7, in the primary transferring nip portion 9, and even of the toners of the same color, the toner that has a greater number of times of passing through the primary transferring nip portion has a larger charge amount (triboelectricity) shortly before the secondary transfer, as shown in FIGS. 8A and 8B.

It is known that the optimum secondary transferring bias also increases in proportion to the charge amount of the toner, as described above, and this results in different optimum secondary transferring biases when the secondary transfer is performed with two times of passing through the primary transferring nip portion and when the secondary transfer is performed with three times of passing. In the conventional example, the number of times of passing through the primary transferring nip portion 9 in association with the non-magnetic toner images is two for (αM) and three for (βM), and in association with the magnetic toner images, three for (αk) and two for (βk).

However, as shown in FIG. 9, since the non-magnetic toners originally have a smaller difference of triboelectricity between themselves, it is possible to obtain a common optimum secondary transferring bias even if the number of times of passing is different.

However, the magnetic toners (αk) and (βk) have a larger difference of charge amount changes in relation to the number of times of passing than the non-magnetic toners as shown in FIG. 8B, and when the same amount of charge is applied to the above magnetic Bk toner images (αk) and (βk) by the above post charger 2 illustrated in FIG. 4, either the magnetic toner (βk) that passes through the primary transferring portion 9 twice or the magnetic toner (αk) that passes three times might cause a poor secondary transfer. More specifically, either the full color toner image (α) or (β) constituting the toner image of two sheets on the intermediate transferring member might cause a poor secondary transfer during the secondary transfer.

SUMMARY OF THE INVENTION

The present invention has been achieved in view of the foregoing problems, and its object is to provide an image forming apparatus capable of performing a favorable secondary transfer even when the order of forming a toner image of each color on an intermediate transferring member is changed.

A preferred embodiment for attaining the above object is provided by an image forming apparatus having:

latent image forming means for forming an electrostatic latent image on an image bearing member;

a plurality of developing means for developing the electrostatic latent image on the image bearing member with a developer;

primary transferring means for transferring by sequentially superposing each developer image developed by the plurality of developing means on an intermediate transferring member;

secondary transferring means for collectively transferring onto a transferring material the developer images transferred by being superposed on the intermediate transferring member; and charging means for charging the developer images on the image bearing member;

wherein the charging means decides a charging condition in accordance with the order of transferring the developer images onto the intermediate transferring member.

DETAILED DESCRIPTION OF THE EMBODIMENT

Embodiments of the present invention will hereinafter be described in reference to the appended drawings.

Figure 2:
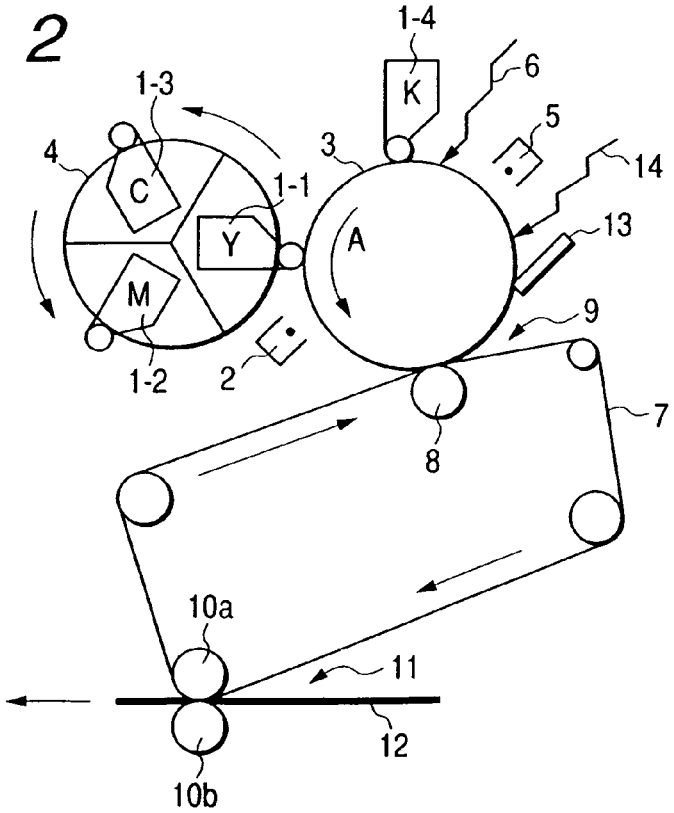
FIG. 2 is a schematic constitutional view of an image forming apparatus according to the present invention.

FIG. 2 is a sectional view of the constitution of an image forming apparatus according to the present invention.

A photosensitive drum 3 that rotates in a direction of an arrow A is an amorphous silicon-based photosensitive member having positive charging properties, and evenly and positively charged by a charger 5, and an electrostatic latent image is formed by a laser light 6.

Three developing devices 1-1, 1-2 and 1-3 which store toners charged to have a negative polarity of colors including three colors of Y, M and C respectively, and a developing device 1-4 which stores a toner of Bk charged to have a negative polarity are disposed around the photosensitive drum 3.

One of these developing devices 1-1, 1-2 and 1-3 is selected to come close to the photosensitive drum 3 by changing means 4, while the developing device 1-4 is always close thereto, and one of these two developing devices close thereto is used for developing the electrostatic latent image on the photosensitive drum 3, thereby forming a toner image on the photosensitive drum 3.

It should be noted that a bias of the negative polarity, which is the same polarity as that of the toner, is applied to a post charger 2 to give a negative polarity charge to a Bk toner image on the photosensitive drum 3.

A two-component developer is used which comprises a magnetic one-component toner for the Bk (black), and a non-magnetic toner and a magnetic carrier for the Y (yellow), M (magenta) and C (cyan), thus combining a one-component developing method and a two-component developing method.

Next, a bias is applied to a primary transferring roller 8 so as to give a charge having a polarity reverse to that of the toner onto a rear surface of an intermediate transferring belt 7, and the above toner image developed on the photosensitive drum 3 is primary-transferred onto the intermediate transferring belt 7 via a primary transferring nip portion 9. A primary transferring residual toner remaining on the surface of the photosensitive drum 3 that has finished the primary transferring is removed and collected by a cleaning member 13, and further residual charge is removed by an exposure 14, and then an image forming process of a next color is started.

This primary transferring step is repeated for the toner images of the four colors, thus forming a full color toner image with the four colors superposed on the intermediate transferring belt 7. Then, a charge having a polarity reverse to that of the toner is given from a secondary transferring outer roller 10*b* to which a bias is applied onto a back side of a transferring material 12 which is held and conveyed by a secondary transferring portion 11 formed among a secondary transferring inner roller 10*a*, the intermediate transferring belt 7 and the secondary transferring outer roller 10*b*, so as to secondary-transfer the above full color toner image collectively onto the transferring material 12. The full color toner image is fixed by an unillustrated fixing device to obtain an image on the transferring material 12. A secondary transferring residual toner remaining on the intermediate transferring belt 7 that has finished the above-described secondary transfer is removed by an unillustrated cleaning member.

Conductive rubber rollers having a resistance of $10^6$ Ω·cm are used for the above primary transferring roller and secondary transferring roller.

For the above intermediate transferring belt 7, a PI (polyimide) resin belt with no end having a thickness of about 75 μm in which resistance is adjusted with carbon to have a volume resistivity of about $10^8$ to $10^9$ Ω·cm is used.

The image forming apparatus above has a one-image mode for forming a toner image of one sheet of transferring material (α) on the intermediate transferring belt 7 and a two-image mode for forming toner images (α) and (β) of two sheets, and a case of the two-image mode in which the order of forming the images is changed will be described herein.

Figure 5A:
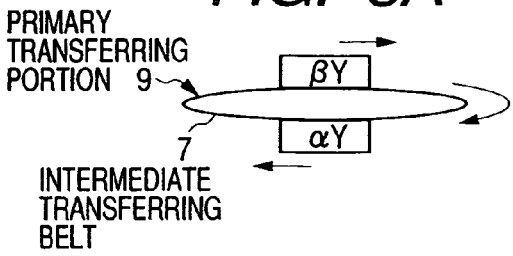
FIGS. 5A, 5B, 5C, 5D, 5E, 5F and 5G are pattern diagrams showing the order of superposing images.
Figure 5B:
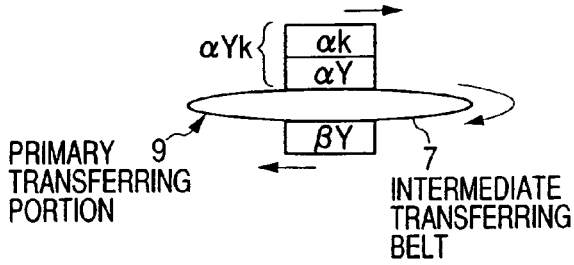
Figure 5C:
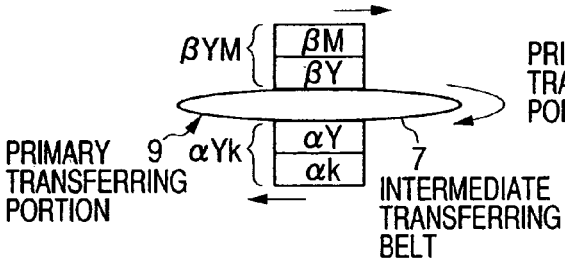
Figure 5D:
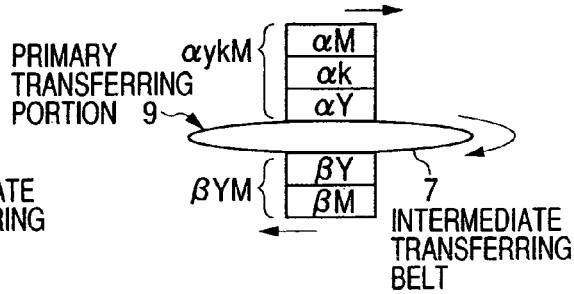
Figure 5E:
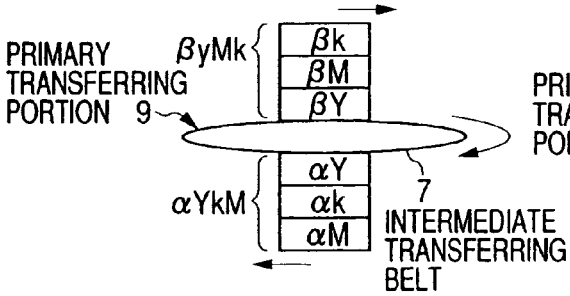
Figure 5F:
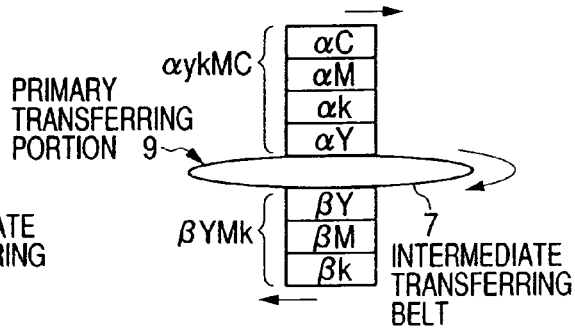
Figure 5G:
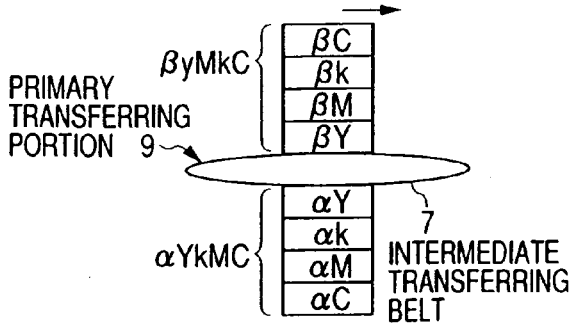
Figure 6:
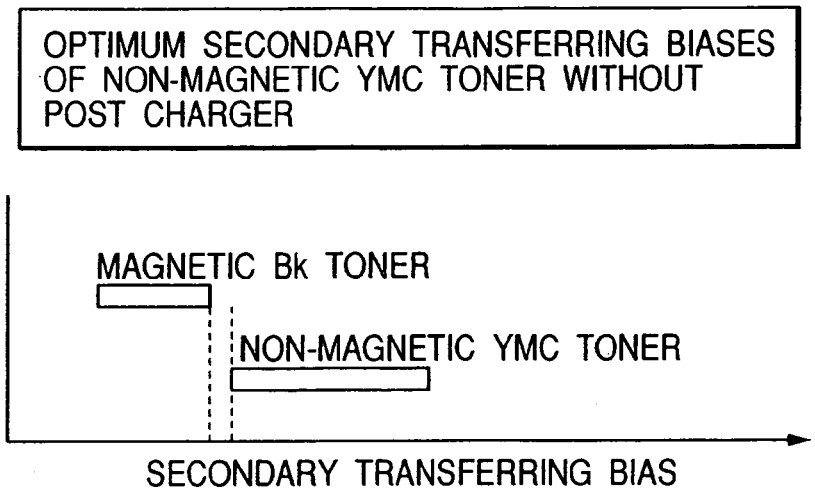
FIG. 6 is a graph illustrating how an optimum secondary transferring bias is for each toner.
Figure 7:
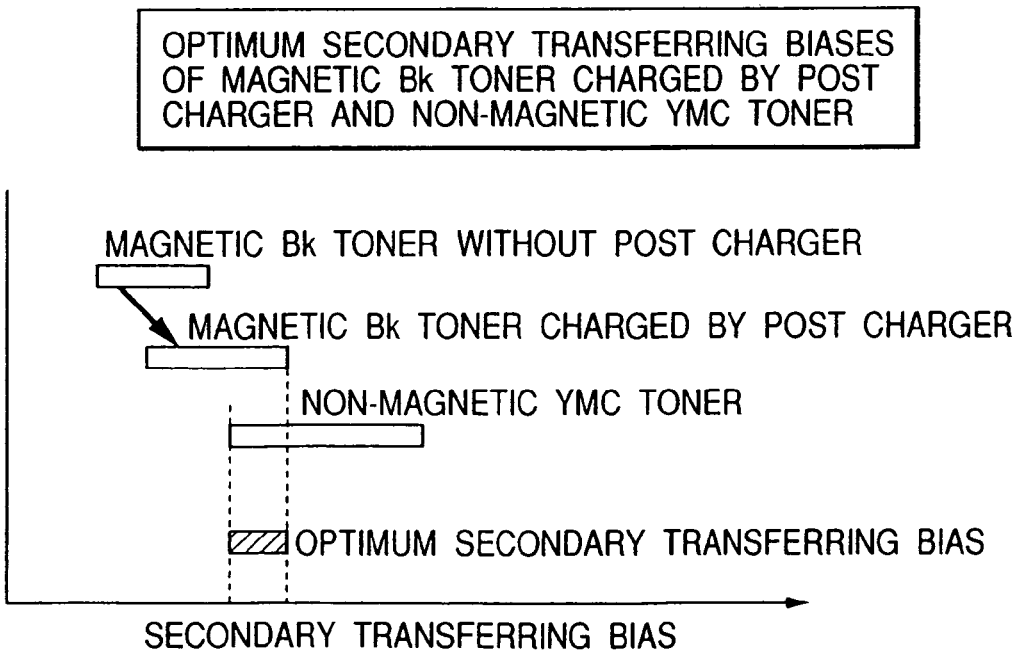
FIG. 7 is a graph illustrating how the optimum secondary transferring bias is for each toner when post charging is performed.

First, toner images Y (αY) and (βY) of a single color are developed in this order on the photosensitive member 3 by the developing device 1-1 selectively close to the photosensitive member 3, and then primary-transferred onto the intermediate transferring belt 7 as shown in FIG. 5A, and while the developing device to be selectively close to the photosensitive member 3 is being changed from the developing device 1-1 to the developing device 1-2, only a toner image (αk) of a single color Bk is developed on the photosensitive member 3 by the developing device 1-3 which is always close to the photosensitive member 3, and then a negative polarity bias Vα is applied to the post charger 2 to give a negative charge to the toner image (αk), and then the toner image (αk) is superposed on the toner image (αY) of the single color Y on the intermediate transferring belt 7 for the primary transfer, thereby forming a toner image (αYk) on the intermediate transferring belt 7 as shown in FIG. 5B, and moreover, toner images (βM) and (αM) of a single color M are developed in this order on the photosensitive member 3 by the developing device 1-2 which has been changed and come close to the photosensitive drum, and then are sequentially superposed on the toner image (βY) and the toner image (αYk) of the single color Y on the intermediate transferring belt 7 for the primary transfer, so as to form toner images (βYM) and (αYkM) on the intermediate transferring member 7 as shown in FIGS. 5C and 5D, and then, while the developing device to be selectively close to the photosensitive member 3 is being changed from the developing device 1-2 to the developing device 1-4, only a toner image (βk) of the single color Bk is developed on the photosensitive member 3 by the developing device 1-3 which is always close to the photosensitive member 3, and then a negative polarity bias Vβ is applied to the post charger 2 to give a negative charge to the toner image (βk), and then the toner image (βk) is superposed on the toner image (βYM) on the intermediate transferring belt 7 for the primary transfer so as to form a toner image (βYMk) on the intermediate transferring belt as shown in FIG. 5E, and further, toner images (αC) and (βC) of a single color C are developed in this order on the photosensitive member 3 by the developing device 1-4 which has been changed and come close to the photosensitive drum 3, and then are sequentially superposed on the toner images (αYkM) and (βYMk) on the intermediate transferring belt 7 for the primary transfer, so as to form toner images (αYkMC) and (βYMkC) on the intermediate transferring member as shown in FIGS. 5F and 5G, and the full color toner images (αYkMC) and (βYMkC) on the intermediate transferring belt 7 formed by the above repeated primary transferring step are secondary-transferred onto the transferring material 12 collectively.

Here, setting of an absolute value Vα of the negative bias applied to the post charger 2 (applied voltage of the post charger in relation to the toner image αk that passes through the primary transferring portion three times) and of Vβ (applied voltage of the post charger in relation to the toner image βk that passes through the primary transferring portion twice) will be described.

Figure 3:
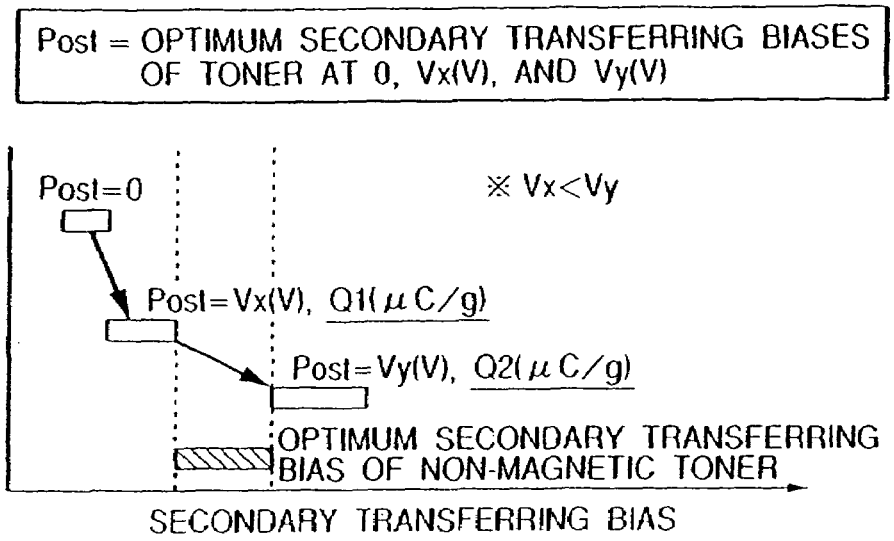
FIG. 3 is a graph for describing the embodiment of the present invention.
Figure 4:
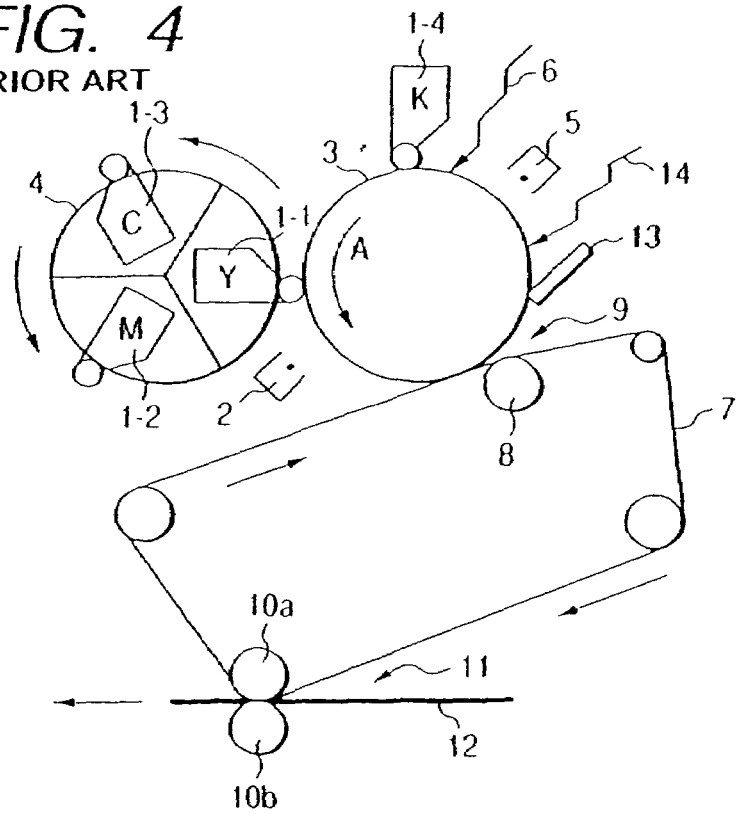
FIG. 4 PRIOR ART
FIG. 4 is a schematic constitutional view of a conventional image forming apparatus.

First, as shown in FIG. 3, a secondary transferring bias is fixed to a minimum value in the range of optimum secondary transferring bias of the non-magnetic toner, and the bias applied to the post charger 2 is adjusted to gradually increase the charge amount of the magnetic toner (Bk), and in accordance with this, by use of an optimum primary transferring bias without image defects, an absolute value Q1 (μC/g) of the charge amount per unit mass of the magnetic toner (Bk) shortly before the second transfer when the magnetic toner (Bk) has stopped causing poor second transferring is found.

Similarly, the secondary transferring bias is fixed to a maximum value in the range of the optimum secondary transferring bias of the non-magnetic toner, and the bias applied to the post charger 2 is adjusted to gradually increase the charge amount of the magnetic toner (Bk), and in accordance with this, by use of the optimum primary transferring bias without image defects, an absolute value Q2 (μC/g) of. the charge amount per unit mass of the magnetic toner (Bk) shortly before the second transfer when the magnetic toner (Bk) stopped causing poor second transferring and starts again causing poor second transferring is found.

Figure 1:
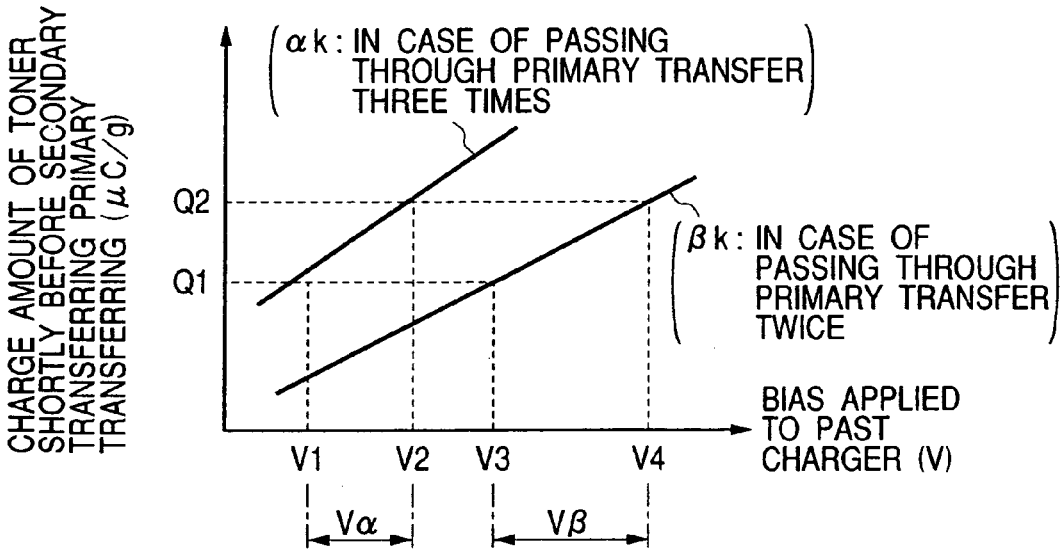
FIG. 1 is a graph for describing an embodiment of the present invention.

For each of the toner images (αk that passes through the primary transferring portion three times) and (βk that passes through the primary transferring portion twice) in the present embodiment, the bias applied to the post charger 2 is changed to perform the primary transfer, and the result of finding the relationship of the charge amount (μC/g) per unit mass of the toners shortly before the second transfer between the (αk) and (βk) is as shown in FIG. 1. Note that a primary transfer bias value should be an optimum value in accordance with the bias applied to the post charger 2.

It is appreciated from FIG. 1 that a voltage applied to the post charger needs to be higher for the toner image, which has a smaller number of times of passing through the primary transfer, that is, which is later in the order in being transferred onto the intermediate transferring member.

Therefore, the magnetic toner and non-magnetic toner can both be transferred collectively without causing a poor secondary transfer when the charge amount per unit mass of the toners shortly before the second transfer lies between Q1 and Q2, thus resulting in from FIG. 1 as follows:

$$V1 \leqq V\alpha \leqq V2,\ V3 \leqq V\beta \leqq V4$$

In the present embodiment, an example has been shown where charging by means of the post charger is performed only for the magnetic toner which vastly differs in the charge amount from the non-magnetic toner. However, when the charge amount differs significantly even between the non-magnetic toners and thus a common optimum secondary transferring bias can not be provided, it is preferable to use the post charger also for the non-magnetic toners for adjustment of triboelectricity. In so doing, the voltage applied to the post charger may be a value that corresponds to the number of times of passing through the primary transfer (order of transfer onto the intermediate transferring member) as described above.

The present invention can be applied also to the image forming apparatus in which, when triboelectricity values are different among a plurality of developing devices preventing the optimum secondary transferring bias from being shared in that state, a developer image formed by each developing device is properly charged by the post charger so as to decrease the triboelectricity difference in the developers associated with the respective developing devices. In this case, the voltage value applied to the post charger is set to a control value corresponding to the developing devices. Thus, characteristic data as shown in FIG. 1 is provided for each developing device and used for control.

Furthermore, in the present embodiment, such an example has been described that when the one-image mode for forming the toner image of one sheet of transferring material (α) on the intermediate transferring belt 7 is shifted into the two-image mode for forming the full color toner images (α) and (β) of two sheets and the order of forming the magnetic Bk toner image is changed in the (α) and (β), the control of the post charger 2 is changed so as to control the applied bias value to be Vα and Vβ. However, it is needless to mention that the present invention is effective not only in the case of the image modes but also in the case where the order of superposing the toner images is changed for other purposes.

Still further, in the present embodiment, although a method of controlling the voltage value applied to the post charger has been described, an applied current value may be controlled.

Alternative Embodiment

The present embodiment is characterized in that the value of the voltage applied to the post charger is decided taking into account the result of detecting patch images formed on the photosensitive drum as well as the order of superposing the toner images. According to the present embodiment, even when the toner triboelectricity has varied due to the long-term use of the apparatus or the like, it is possible to provide a stable secondary transfer.

The present embodiment will hereinafter be described.

Figure 10:
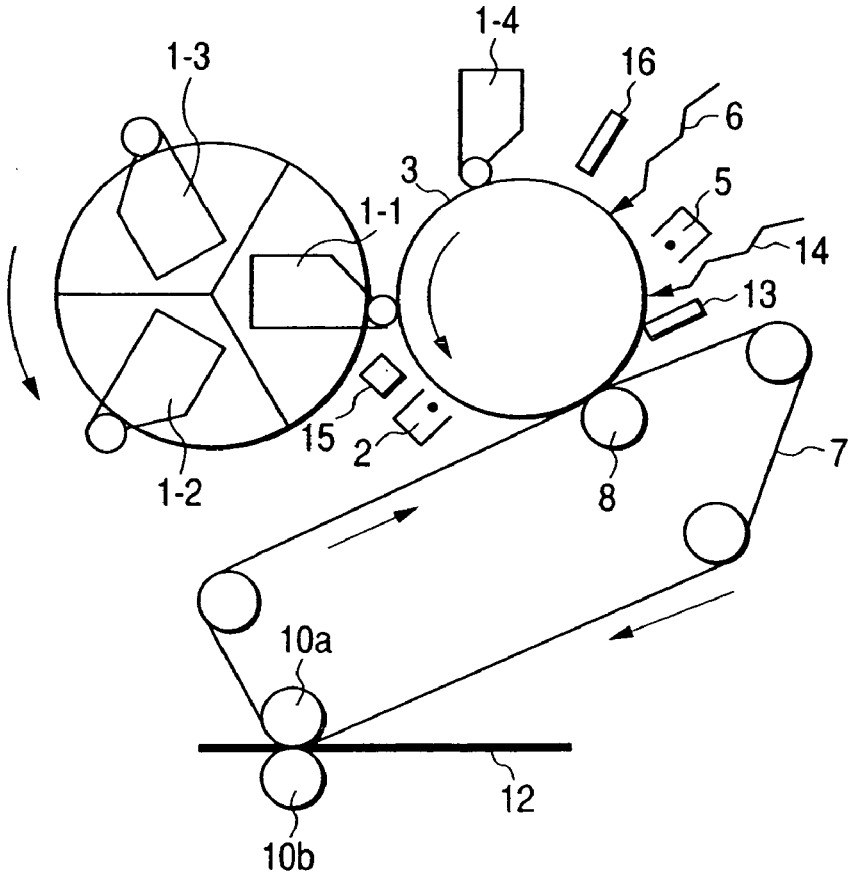
FIG. 10 is a schematic constitutional view of the image forming apparatus in alternative embodiment according to the present invention.

FIG. 10 is a view illustrating the image forming apparatus in the present embodiment, in which components similar to those in the previous embodiment have the same reference characters. In the above drawing, 15 is density detecting means for detecting the density of the patch images formed on the photosensitive drum 3, and 16 is potential detecting means for detecting surface potential of the photosensitive drum 3.

The patch images are formed in the following manner.

Figure 11:
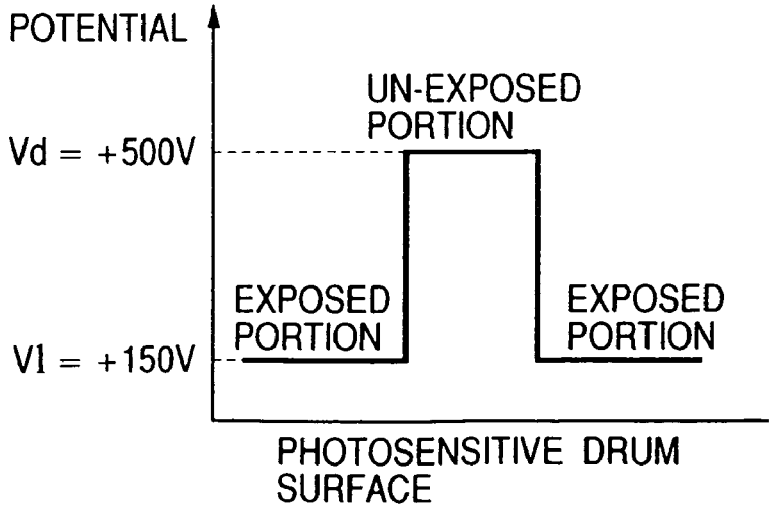
FIG. 11 is a graph illustrating the state of potential on a surface of a drum.

As shown in FIG. 11, the photosensitive drum 3 is evenly charged to Vd=+500V, and a portion of VI =+150V is properly formed by the laser light 6, thereby forming a latent image for the patch. In so doing, if potential control is performed while the surface potential of the drum is being detected by the surface potential detecting means 16, it is possible to form a more accurate latent image.

Figure 12:
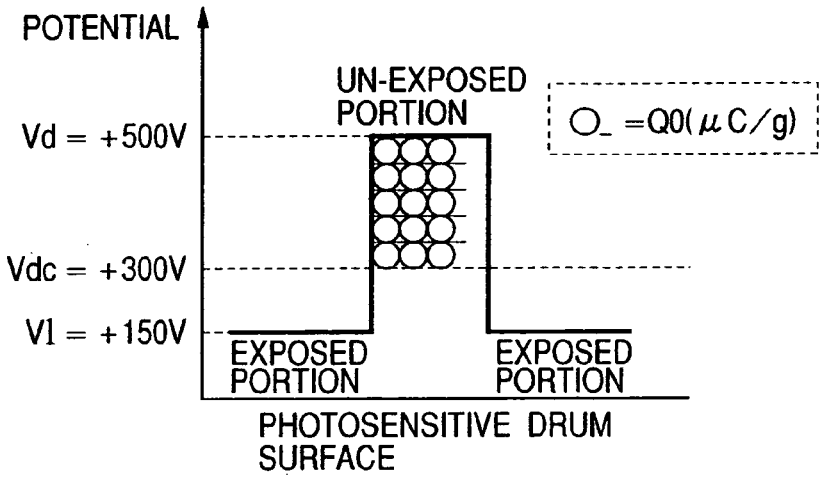
FIG. 12 is a graph illustrating the state where a patch toner is on the surface of the drum.

Next, as shown in FIG. 12, a developing bias Vdc=+300V is applied to the developing device 1-4 having a negatively charged toner, and the toner patch is formed by a potential contrast with the Vd portion. The amount of the toner developed here will be a value corresponding to the charge amount Q0 (μC/g) of the toner.

Figure 13:
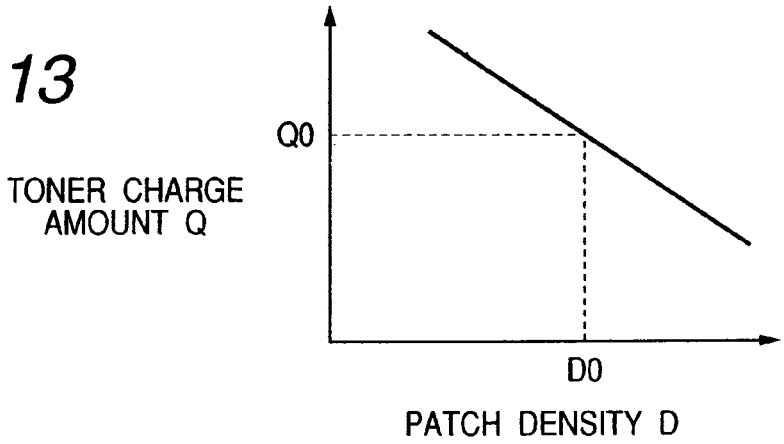
FIG. 13 is a graph illustrating patch density and toner charge amount.

The density detecting means 15 has a light emitting portion and a light receiving portion, and detects the toner patch density on the photosensitive drum 3 by receiving reflected light from the light emitting portion. It has been found out from experiments that the toner charge amount Q and the toner patch density D have a correlation as shown in FIG. 13. More specifically, such a tendency is found that as the patch density increases, the toner charge amount decreases. Thus, by forming the patch image under a predetermined potential contrast and detecting its patch density, it is possible to know the toner triboelectricity at the point.

Figure 14:
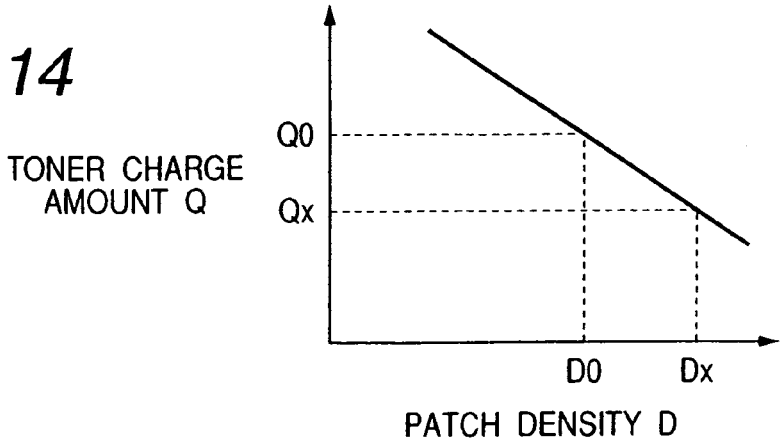
FIG. 14 is a graph illustrating the patch density and the toner charge amount.

Incidentally, it the image forming apparatus is kept using, the toner charge amount Q might decrease from Q0 to Qx as shown in FIG. 14, and the patch density in that case is detected as Dx.

If the toner charge amount of the apparatus at an initial point is Q0 and the bias applied to the post charger 2 is in a range shown in the previous embodiment of V1≦Vα≦V2, V3≦Vβ≦V4, the toner charge amount of the toner images αk and βk shortly before the second transfer can be put in a range that is an optimum range Q1 to Q2 shown in FIG. 1. However, if the toner charge amount decreases from Q0 to Qx due to continued use of the apparatus, the toner charge amount of the toner images αk and βk shortly before the second transfer will be equal to or less than Q1 when the voltage applied to the post charger remains as above, which might cause a poor transfer.

Therefore, in the present invention, changes in the toner charge amount are detected by detecting the patch density, and in accordance with the detection result, the voltage applied to the post charger decided on the basis of the order of image formation is corrected.

Its concrete method will be shown below.

As has also been described previously, it is possible to know the toner charge amount at a particular point by forming the patch image as shown in FIG. 11 and FIG. 12, detecting its density, and referring to characteristics in FIG. 13. The toner charge amount detected at that point is Qx.

V1, V2, V3 and V4 in FIG. 1 are respectively corrected to V1', V2', V3' and V4' in accordance with the changes in the toner charge amount. If the toner charge amount at the initial point is Q0, the V1', V2', V3' and V4' are expressed as follows:

$$V1'=V1\times(Qx/Q0)$$

$$V2'=V2\times(Qx/Q0)$$

$$V3'=V3\times(Qx/Q0)$$

$$V4'=V4\times(Qx/Q0)$$

Therefore, the voltages Vα, Vβ applied to the post charger after correction are in the range below.

$$V1'\leqq V\alpha\leqq V2',\ V3'\leqq V\beta<V4'$$

According to the configuration above, it is possible to perform a stable secondary transfer without dependence on the order of image formation of the toner images and even when the toner triboelectricity has varied due to the long-term use of the apparatus or the like.

What is claimed is:

1. An image forming method comprising the steps of:

forming a first toner image;

applying a first charge having a same polarity as the first toner image to the first toner image;

transferring electrostatically the first toner image applied with the first charge to an intermediate transferring member;

forming a second toner image;

applying a second charge having a same polarity as the second toner image to the second toner image;

transferring electrostatically the second toner image applied with the second charge to the intermediate transferring member bearing the first toner image; and transferring the first and second toner images from the intermediate transferring member to a recording material, wherein a charge amount of the first charge is different from a charge amount of the second charge.

2. An image forming method according to claim 1, wherein the charge amount of the second charge is greater than the charge amount of the first charge.

3. An image forming method according to claim 2, further comprising the steps of:

forming a first test pattern;

detecting the first test pattern;

controlling variably the charge amount of the first charge on the basis of a result of detection of the first test pattern;

forming a second test pattern;

detecting the second test pattern; and controlling variably the charge amount of the second charge on the basis of a result of detection of the second test pattern.

* * * * *

UNITED STATES PATENT AND TRADEMARK OFFICE

CERTIFICATE OF CORRECTION

PATENT NO. : 7,062,208 B2
APPLICATION NO. : 10/990491
DATED : June 13, 2006
INVENTOR(S) : Hiroki Takayanagi It is certified that error appears in the above-identified patent and that said Letters Patent is hereby corrected as shown below:

IN THE DRAWINGS

Figure 8A:
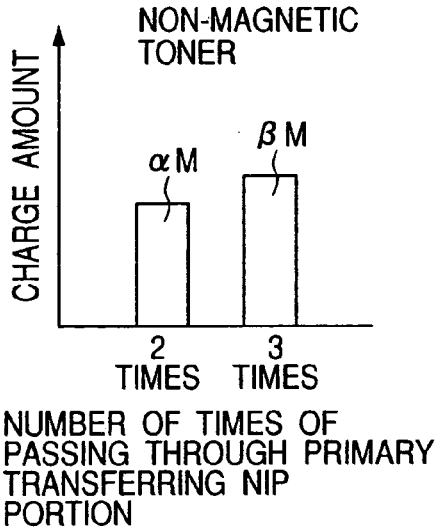
FIGS. 8A and 8B are graphs illustrating the relationship between the number of times of passing through a primary transfer and toner triboelectricity.
Figure 8B:
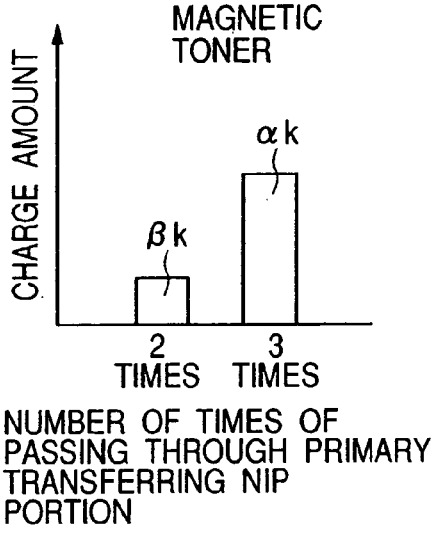
Figure 9:
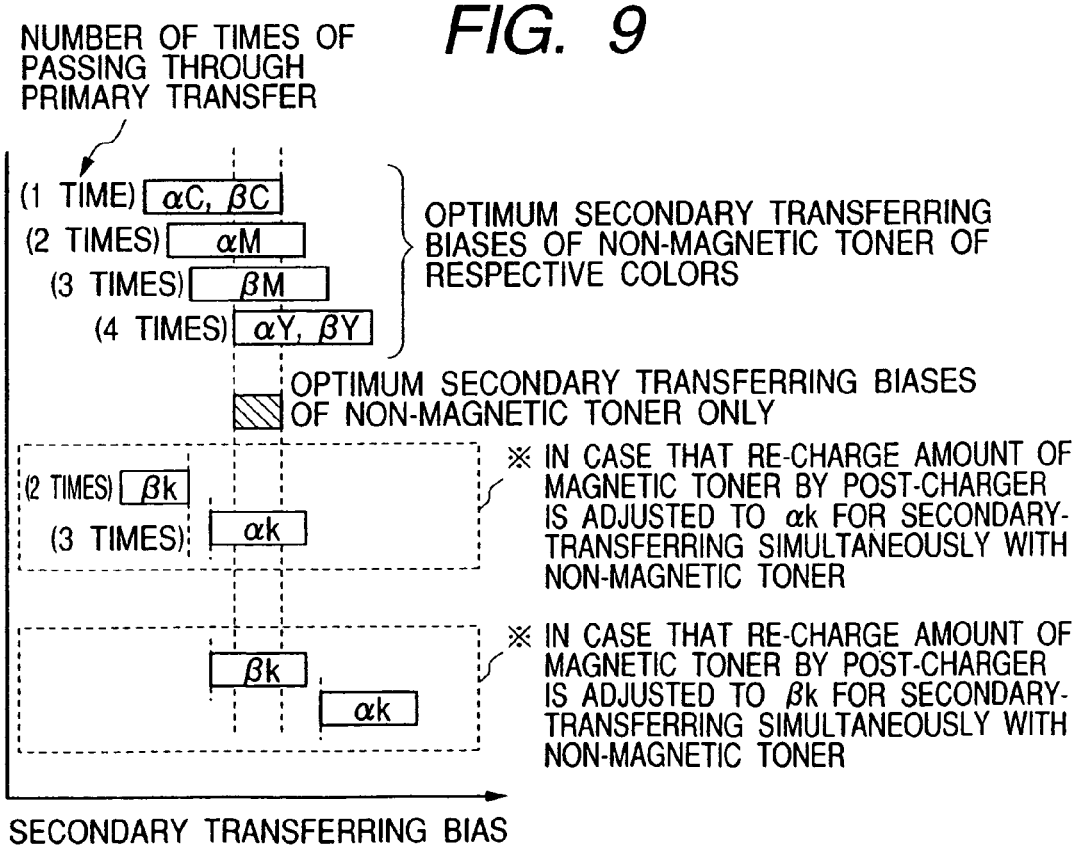
FIG. 9 is a graph illustrating how the optimum secondary transferring bias is for each toner.

Sheet 1, Fig. 1, "TRANSFERRING PRIMARY" should read --TRANSFERRING / PRIMARY--; and Sheet 5, Figs. 8A and 8B, "CHARGE AMOUNT OF TONER ON INTERMEDIATE TRANSFERRING BELT VERSUS" should read --CHARGE AMOUNT OF TONER ON INTERMEDIATE TRANSFERRING BELT VERSUS NUMBER OF TIMES OF PASSING THROUGH PRIMARY TRANSFERRING NIP PORTION--

COLUMN 1

Line 8, "application" (second occurrence) should read --Application--.

COLUMN 8

Line 1, "of." should read --of--.

COLUMN 9

Line 43, "it" should read --if--.

Signed and Sealed this

Twenty-sixth Day of December, 2006

JON W. DUDAS
*Director of the United States Patent and Trademark Office*